United States Patent [19]

Berman et al.

[11] 4,121,335

[45] Oct. 24, 1978

[54] METHOD OF MANUFACTURING BIMETALLIC STRIP

[76] Inventors: Samuil Izrailevich Berman, ulitsa Polbina 46, kv. 263; PetrMikhailovich Nikiforov, 2 Vladimirskaya ulitsa 37, korpus 1, kv. 65, both of Moscow, U.S.S.R.

[21] Appl. No.: 774,111

[22] Filed: Mar. 3, 1977

Related U.S. Application Data

[60] Continuation of Ser. No. 601,709, Aug. 4, 1975, abandoned, which is a division of Ser. No. 349,666, Apr. 9, 1973, abandoned.

[51] Int. Cl.[2] ..... H01R 43/06

[52] U.S. Cl. ..... 29/597; 29/527.6; 29/527.7; 164/98; 164/112

[58] Field of Search ..... 29/597, 527.5, 527.6, 29/527.7, 190, 191.6; 310/233-237; 164/98, 112

[56] References Cited

U.S. PATENT DOCUMENTS

| | | | |
|---|---|---|---|
| 383,192 | 5/1888 | Seaman | 29/191.6 |
| 418,767 | 1/1890 | Spooner | 164/112 |
| 1,441,688 | 1/1923 | Jones | 29/191.6 |
| 2,436,910 | 3/1948 | Werner | 29/597 |

*Primary Examiner*—Carl E. Hall

*Attorney, Agent, or Firm*—Haseltine, Lake & Waters

[57] ABSTRACT

A method of manufacturing a bimetallic strip for commutators of electric machines, consisting in the use of a casting mould having a shape defined by a rectangle and a semicircle, the larger side of the rectangle being the diameter of the semicircle. A steel core of a rounded shape, which is cleaned from scale and degreased, is placed into the casting mould, and then molten copper is poured into the mould so as to form a diffusion layer between the steel core and the copper layer. Then the resulting ingot is extracted and subjected to pressure shaping in hot and cold state until predetermined dimensions of the bimetallic strip cross section are obtained.

2 Claims, 4 Drawing Figures

METHOD OF MANUFACTURING BIMETALLIC STRIP

The present application is a continuation of the parent application Ser. No. 601,709, filed Aug. 4, 1975, now abandoned, which application is a divisional application of Ser. No. 349,666, filed Apr. 9, 1973, now abandoned.

The invention relates to the field of electric machines, such as motors and generators having commutators, and more specificially to a method of manufacturing a bimetallic commutator strip.

At present, in order to contribute to the further development of electric machines, and more particularly, to the development of highly efficient commutator-type machines, it is necessary to increase the speed of the rotating parts, in particular of the commutators. However, at high rotational speeds of heavy-duty commutators the commutator segments cannot withstand in the fastening zone the loads imposed by centrifugal forces and are deformed with the result that the segments are displaced relative to each other. Thus, the continuity of the commutator is impaired, and some segments project more forwardly relative to the others in the zone of sliding contact with the associated brushes. During the rotation of the commutator the projecting segments hit the brushes, thereby distorting the sliding surface. This results in sparking and formation of flashover on the commutator, and the electric machine becomes inoperable.

In order to improve quality and reliability, as well as to ensure operability of the commutator type electric machines and to reduce copper consumption, various structures of bimetallic commutator segments have been contemplated, in which the fastening zone - the dovetail — is made of steel so as to increase mechanical strength and to reduce copper consumption, while the live part of the segment is made of copper.

Known bimetallic commutator segments made of two different metals namely the upper live part of copper and the lower tail part of steel, can be manufactured by the method of powder metallurgy, comprising the steps of pressing copper and iron powders poured into a press mould under a predetermined pressure, with successive sintering at a predetermined temperature. The segments manufactured by the above-described method exhibit lower physical and mechanical properties as compared to the segments made of a monometal blank by rolling and drawing thereof.

The live part of the bimetallic commutator segment made of a copper powder has:

- density of 8.8 g/cm$^3$;
- resistivity of 0.020 ohm.mm$^2$/m;
- hardness of 75 H Br.

A monomentallic copper commutator segment made by rolling and drawing has:

- a density of 8.9 g/cm$^3$;
- resistivity of 0.018 ohm.mm$^2$/m;
- hardness of 95 H Br.

The tail part of a bimetallic segment made by sintering of iron powder also has low strength properties, since the sintering temperature of copper powder is lower than that of iron powder.

The same bimetallic segment can be obtained also by the metallurgical method. By this method a rectangular steel stock is placed into a cast mould after a preliminary treatment and, upon heating the mould, it is filled with molten copper. The resulting two-layer blank is hot rolled and drawn.

During the rolling of this blank both copper and steel components contact the rolls, and due to different plastic properties and coefficients of friction of these components, the rolled blank is bent toward the copper component, thereby hampering the hot rolling. For that reason this method has not found commercial application.

Another method of manufacturing bimetallic commutator segments by the method of powder metallurgy has been also contemplated (cf. U.S. Pat. No. 3,411,197, British Pat. No. 1,045,918 and German Pat. No. 1,241,901).

In this case the commutator segments are made by rolling on the basis of steel and copper powders, a rhombic strip having the edges made of steel powder and the central portion of copper powder, with subsequent sintering of the strip concurrrently with hot compaction in a protective medium, and cutting the segments out of the strip. The method of manufacturing mainly consists of three steps: rolling of a rhombic bimetallic strip from copper and steel powders, sintering of the strip concurrently with hot compaction rolling in a continuous electrical furnace in protective medium, and stamping of the commutator segments.

The common disadvantage of the above-described structures consists in that the components of a bimetallic commutator segment exhibit different coefficients of thermal expansion. Therefore, during the operation, when the commutator is heated, deformation takes place, resulting in the loss of integrity of the commutator.

Furthermore, in all of the above-mentioned structures both components are exposed and have the trend to the formation of an active galvanic pair, copper-steel under the influence of the environment thus leading to destruction of the boundary zone between the components.

The shape stability of the commutator during the operation is a necessary condition to ensure good commutation. For that reason attempts were made to substitute partly or entirely copper with other metals in order to reduce the load imposed in the operation in the fastening zone of the commutator segments under the action of centrifugal forces.

Known in the art is a structure of a bimetallic commutator segment shown in FIG. 4, as will be explained hereunder.

The disadvantage of this structure consists in the absence of the disclosure of a method of manufacturing such a segment which could provide for the obtainment of a strip of the shape shown and for strong binding between the components, ensuring the required mechanical strength in the dovetail zone, as well as the predetermined hardness of the live part of the strip.

It is an object of the present invention to eliminate the above disadvantages.

The inventive method results in a bimetallic strip for commutators of electric machines, which ensures the required mechanical strength, while retaining high electric conductance.

The resulting bimetallic trapezoidal strip has an outer layer made of a metal exhibiting high electric conductance, such as copper or copper-based alloys, said outer layer forming a continuous envelope, and an inner layer made of a metal having a greater strength, such as steel, said inner layer being shifted along the axis of symmetry of the trapezoidal cross section toward the smaller base of the trapezium. The inner layer of the strip is of a drop-like shape with an enlargement on the side of the larger base, or of a near elliptical shape, and a diffusion layer being formed between the above-said layers over the whole surface of their mutual contact.

It is recommended to select the cross-sectional area of the inner layer of the bimetallic strip on the basis of the size of a fastening zone of a bimetallic in the commutator and so that this area be somewhat greater than the cross-sectional area of a dovetail in the sgement.

The bimetallic strip according to the invention is preferably made by a method comprising the steps of using a casting mould having a cross section defined by a rectangle and a semicircle, the larger side of the rectangle being the diameter of the semicircle, placing a steel core of a rounded shape, which is cleaned from scale and degreased, so that it is shifted along the axis of symmetry of the casting mould toward the semicircle and in such a manner as to define a space of at least 2 mm between the core and the mould walls, pouring molten copper into the casting mould in the absence an oxidizing medium and exposing the mould, at a temperature which is somewhat higher than that of the molten copper, for 5–12 minutes so as to form a diffusion layer, whereafter the resulting ingot is extracted from the mould and subjected to pressure shaping in hot and cold state until the predetermined dimensions of the bimetallic strip are obtained.

The invention will now be described in detail with reference to an exemplary embodiment of a bimetallic strip for commutators of electric machines illustrated in the accompanying drawings obtained by the novel method, in which.

Figure 2:
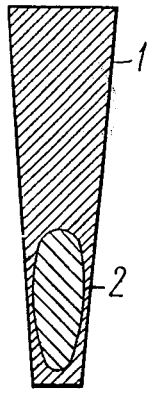
FIG. 2 is a sectional view along the line II—II in FIG. 1.
Figure 1:
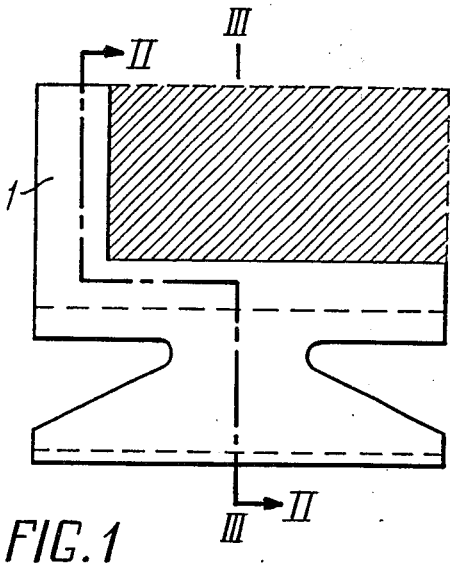
FIG. 1 shows a bimetallic trapezoidal strip for commutators of electric machines, according to the invention.

The inventive embodiment of a bimetallic strip is shown in FIG. 1. This strip is a trapezoidal shape in cross section (FIG. 2). An outer layer 1 is made as a continuous envelope of copper or copper-based alloys, whereas an inner layer 2 is made of a material having a greater strength, such as of steel. The core is of a drop-like cross section with an enlargement on the side of the larger base of the trapezium, or of a cross section that is near elliptical. The core is shifted toward the smaller base of the trapezium, that is located in the zone of fastening a commutator segment made of the strip so that the upper thick edge of the core exceeds the height of the dovetail by at least 2 millimeters.

It can be clearly sen from FIGS. 1 and particularly 2 of the drawings that the preferred example of the inventive bimetallic strip is mainly constituted by the envelope or outer layer 1, having a substantially trapezoidal shape, of which the larger base is toward the top of the drawing and the smaller base toward the bottom edge, the drop-shaped inner layer 2 being located within the outer layer along its axis of symmetry in substantial proximity of the smaller base (that is, at the bottom of the envelope, as shown) while a substantially larger portion of the outer layer 1 is solid between the larger base and the drop-shaped inner layer 2, in more than the upper half of the strip, as can be seen in FIG. 2.

Figure 4:
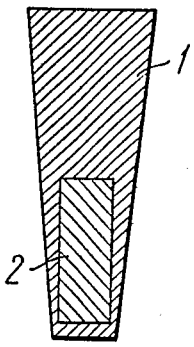
PRIOR ART FIG. 4
FIG. 4 shows a known bimetallic trapezoidal strip for commutators of electric machines.

This embodiment possesses the following advantages against a prior-art structure, such as that shown in FIG. 4. The continuous outer envelope protects the core against contact with the environment, thereby eliminating the possibility of the formation of an active galvanic pair and destruction of the boundary zone between the components of the strip.

During the manufacturing of this strip with the use of the pressure shaping methods (rolling and drawing) only one component will contact a working tool (rolls or drawing die), whereby normal manufacturing procedure is ensured, that is the strip is prevented from being bent due to different coefficients of friction of the components.

With the heating of the commutator during the operation of the associated electric machine the segments made from such a strip will not be bent due to different coefficients of thermal expansion, since the inner core is located inside the continuous envelope.

Furthermore, since the core exhibits a lower coefficient of thermal expansion, the residual stresses will decrease during the plastic deformation.

The drop-like or elliptical shape of the core contributes to an increase in the area of the components surfaces in contact and improves the diagram of forces created in this zone during the rotation of the commutator under the action of centrifugal forces, and the mechanical strength of this zone is also improved.

The inventive method of manufacturing the above-described strip for commutator segments consists in the following. A casting mould has a cross section comprising a rectangle and a semicircle, the larger side of the rectangle being the diameter of the semicircle. A core of a rounded shape in the cross section, which is preliminary cleaned from scale and degreased, is placed into said casting mould in such a manner, that it should be shifted along the axis of symmetry of the mould toward the semicircle and so as to define a space of at least 2 mm between the mould wall and the core surface, and the casting mould is then filled with molten copper or copper-based alloy.

In order to prevent the core from being oxidized, the molten metal is poured in the absence of an oxidizing medium, for instance in a carbon-dioxide atmosphere created by burning charcoal.

The shape of the casting mould and the arrangement of the core therein provide for a position of the core in the finished product where it is shifted toward the smaller base of the trapezium. In addition, where the ingot has a rounded shape at one end, it is easy to locate the core and to ensure the necessary orientation of the strip while feeding it to the rolls during the rolling.

The formation of a diffusion layer, which is required in order to provide for secure binding between the outer and inner layers, is ensured by exposing the mould at a temperature which is somewhat higher than the fusion point of copper or copper-based alloy for 15–12 minutes, the formation of the diffusion layer taking place due to the dissolution of the superficial layer of the core and the diffusion of liquid copper or copper-based alloy into the core. Secure binding between the components is obtained with the diffusion layer the exposure for more than 12 minutes copper or copper-based alloy is contaminated with the core material, thus impairing the electrical properties of the outer layer.

Figure 3:
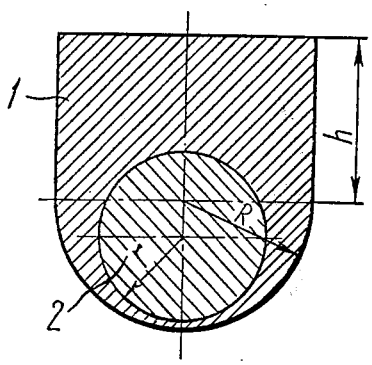
FIG. 3 is a transverse sectional view of an ingot used to obtain the bimetallic strip of FIGS. 1 and 2.

Thus, an ingot is produced (FIG. 3) having the dimensions determined by the following expressions:

$R < h < 2R$ $0.5R < r < 0.8R,$ wherein: $R$ is the radius of the semicircle; $r$ is the reduced radius of the core; $h$ is the height of the rectangle.

The resulting bimetallic ingot is subjected to press shaping in hot and cold state in such a manner that the main pressure is applied perpendicularly with respect to the axis of symmetry of the ingot cross section, whereafter the commutator segments are cut out of the strip.

The above-mentioned relationships between the dimensions of the ingot, whose cross section is defined on one side by the semicircle, as well as the rounded shape of the core shifted toward the semicircle, will ensure, with the use of the abovementioned press shaping method, the maximum possible displacement of the core toward the fastening zone of the commutator segment in the finished product, whereby the maximum possible mechanical strength of this zone and the minimum possible consumption of current-conducting metal in this zone are ensured, while the rounded shape of the core makes it possible to obtain its symmetrical arrangement both in the ingot and in the finished product with sufficient accuracy, the core shape eliminating abrupt rotations thereof during the flow of the components in performing pressure shaping, and creating favourable conditions for the obtainment of a secure binding.

The bimetallic trapezoidal strip obtained by this method ensures maximum possible rigidity and integrity of the commutator, whereby more efficient electric machines can be develop. The method and the ingot shape provide for obtaining the strip with predetermined characteristics.

We claim:

1. A method of manufacturing a bimetallic strip for commutators of electric machines, the strip being characterized by high mechanical strength while retaining high electric conductance, the method comprising the steps of: using a casting mold having a cross-section defined by a rectangle and a contiguous semicircle, the longer side of the rectangle being the diameter of the semicircle, placing a steel core of a substantially round shape, after cleaning from scale and after degreasing, into the mold in such a manner that it is shifted along the axis of symmetry of the mold toward the semicircle, thus defining a space of at least 2 millimeters between the mold walls and the core; subsequently pouring molten copper into the mold in the absence of an oxidizing medium; exposing the mold for 5 to 12 minutes to a temperature which is somewhat higher than the fusion point of the molten copper so as to form a diffusion layer between the steel core and the poured-in copper, with a secure bond between the outer and inner layers; extracting the resulting diffusion-bonded ingot from the mold; and subjecting the same to press shaping until predetermined dimensions of the bimetallic strip are obtained; cutting said strip into commutation segments of predetermined length; forming said commutator segments to a predetermined shape; assembling a commutator from a plurality of said commutator segments; and smoothing surfaces of adjacent segments for providing a smooth surface to be contacted by electrical commutator brushes.

2. A method as defined in claim 1, wherein said diffusion layer between said steel core and the poured-in copper is substantially 15 $\mu$.

* * * * *